US006354357B1

(12) United States Patent
Clark

(10) Patent No.: US 6,354,357 B1
(45) Date of Patent: Mar. 12, 2002

(54) LOST FOAM METHOD OF CASTING A CYLINDER LINER WITH WATER JACKET

(76) Inventor: Richark K. Clark, 868 E. 1400 North Rd., Onarga, IL (US) 60955

( * ) Notice: Subject to any disclaimer, the term of this patent is extended or adjusted under 35 U.S.C. 154(b) by 0 days.

(21) Appl. No.: 09/298,892

(22) Filed: Apr. 26, 1999

(51) Int. Cl.[7] ..... B22C 9/02
(52) U.S. Cl. ..... 164/34; 164/45; 164/137
(58) Field of Search ..... 164/34, 45, 235, 164/246, 137, 340

(56) References Cited

U.S. PATENT DOCUMENTS 5,465,778 A * 11/1995 Clark et al. ..... 164/137

5,960,851 A * 10/1999 Donahue ..... 164/34

* cited by examiner

*Primary Examiner*—Nam Nguyen
*Assistant Examiner*—I. H. Lin
(74) *Attorney, Agent, or Firm*—Kajane McManus

(57) ABSTRACT

The lost foam method of casting a cylinder liner with water jacket comprises the steps of creating a blank identical to the liner desired, with a drain defined therein, from a heat-dissipated material such as styrofoam, coating the blank with core wash, placing the blank into a casting mold, filling the mold and a chamber defined within the blank with sand, pouring hot metal into the mold, extracting the formed metal liner from the mold, draining sand from within the chamber and plugging the sand drain.

7 Claims, 6 Drawing Sheets

LOST FOAM METHOD OF CASTING A CYLINDER LINER WITH WATER JACKET

FIELD OF THE INVENTION

The present invention relates to a method of casting a cylinder liner with water jacket. More particularly, the method teaches the use of at least one styrofoam blank within a mold, the blank being identical in configuration to the cylinder liner cast with the method and defining a chamber therewithin which, when filled with sand prior to casting, will produce the passageway defining a circumferential water jacket. The method is applicable for use in both vertical and horizontal casting techniques.

PRIOR ART

Heretofore, various methods of casting a cylinder liner with water jacket have been proposed. Also, casting may be accomplished in either a vertical or horizontal orientation.

Typically, such casting methods provide a mold which is multisectional, with the sections being positioned to define an air space between inner and outer mold sections which when filled with molten metal, define the cylinder liner. When it is desired to incorporate a water jacket into the liner, a complex core of solidified sand must be produced which, when suspended within the air space between the inner and outer mold sections, will not be replaced by the molten metal, thus creating a water path between inner and outer surfaces of the liner.

To accommodate suspension of such core, which may be of one or more sections, each section includes a plurality of radial arms which extend outwardly of the core and which must engage and be precisely supported by multiple outer sections of the mold for concentricity. This complexity of methodology requires the mold to be complex, of great precision, and therefore time consuming to arrange. It is thus inherently costly.

Further, cylinder liners are presently cast one at a time, due to complexity of the methodology used in creation thereof.

SUMMARY OF THE INVENTION

Accordingly, a primary object of the present invention is to provide a simplified, and less costly, method of casting a cylinder liner with water jacket.

This object, as well as others, is accomplished by the method of the present invention wherein at least one foam blank conforming to the shape of the cylinder liner with water jacket is created and positioned within a mold, the blank including a circumferential cylindrical chamber therein and being coated with core wash, the mold and cylindrical chamber being filled with sand prior to introduction of molten metal into the mold, the molten metal replacing the foam blank, with the foam, dissipated by the heat of the metal, escaping from within the mold in the form of gas, with sand in the chamber being drained via a drain after cooling and removal of the casting, to define the water jacket flow path, with the drain being plugged after drainage of sand therethrough.

DESCRIPTION OF THE PREFERRED EMBODIMENT

Figure 1:
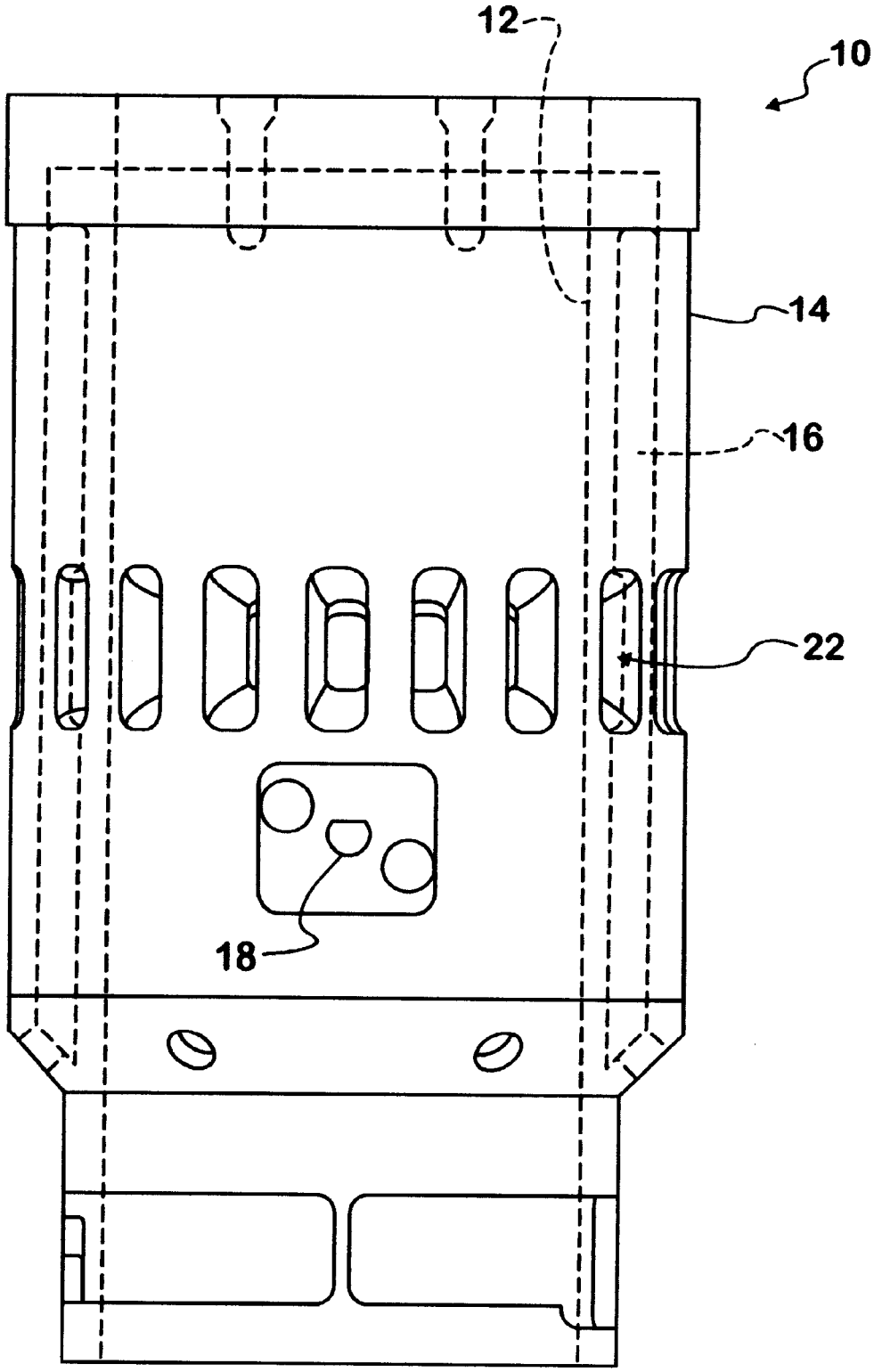
FIG. 1 is a perspective view of a cylinder liner with water jacket cast according to the method of the present invention, with internal structures thereof shown in phantom.

Referring now to the drawings in greater detail, there is illustrated therein a cylinder liner with water jacket made in accordance with the teachings of the method of the present invention and generally identified by the reference numeral 10 (hereinafter referred to as liner 10).

As illustrated, the liner 10 includes an inner cylindrical wall 12 (shown in phantom) and an outer cylindrical wall 14. Between the walls 12 and 14 is defined a chamber 16 which serves as a water passageway, or water jacket, 16 of the liner 10. An entrance 18 into the water jacket 16 is provided at one suitable position and an exit therefrom (not shown) is provided at another suitable position so that there may be a flow of cooling water through the water jacket 16 and into a cylinder head (not shown) to be engaged thereupon.

Further, a plurality of air ports 22 are provided, girdling the liner 10 and extending through the walls 12 and 14 for intake of air by a piston (not shown) reciprocating within the cylinder defined by the inner wall 12, in known manner.

As stated above, creation of the liner 10 has heretofore been a complex, time consuming and expensive task.

Thus there has been a need for a simpler method of producing the liner 10 and it is believed the method of the present invention fills that need.

Referring now to FIGS. 2–9, there is illustrated therein, in its most simplistic form, the method and structures used in accomplishing the method.

Figure 2:
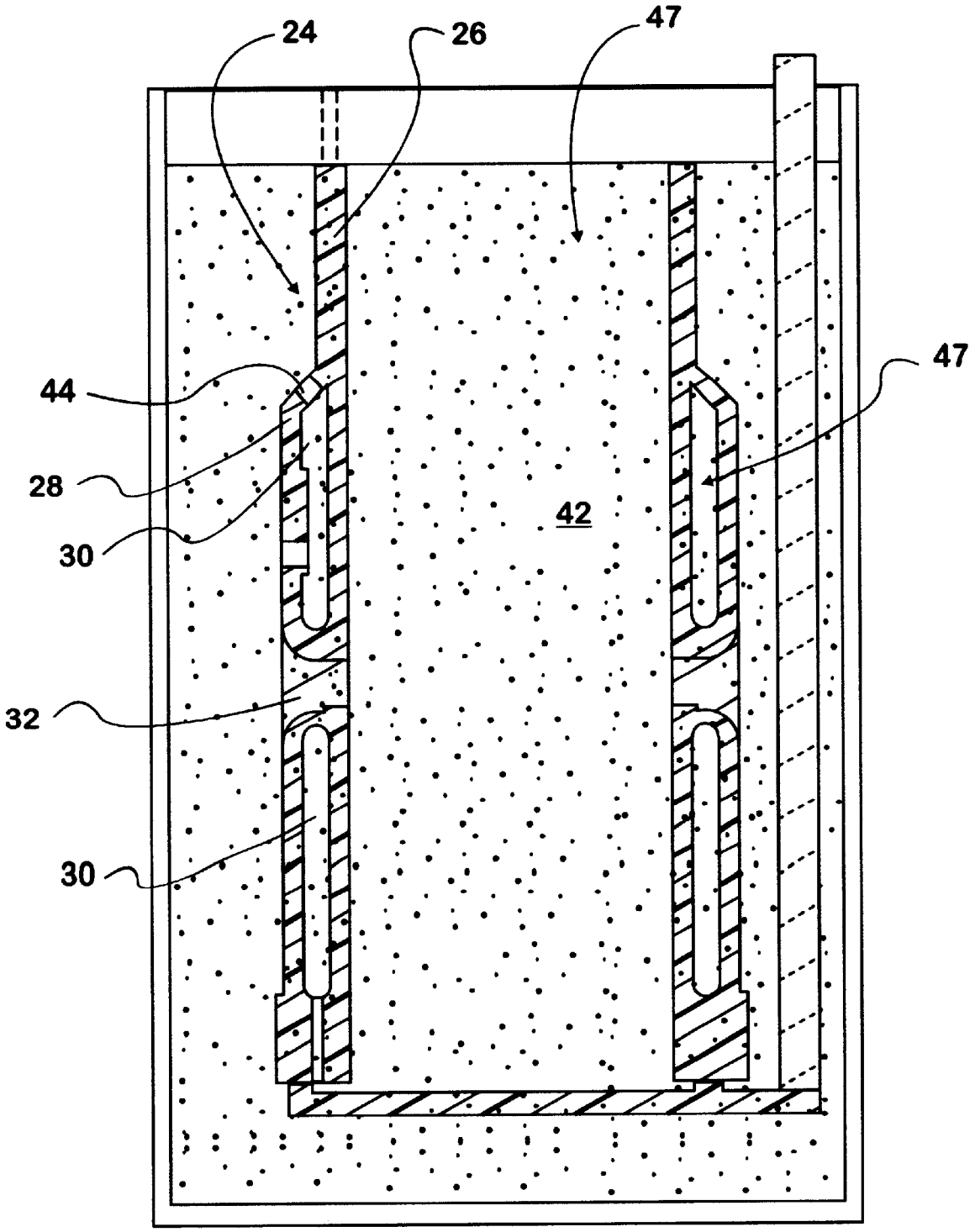
FIG. 2 is a cross sectional view through a mold containing at least one foam blank used in creating the cylinder liner of FIG. 1.

Turning first to FIG. 2 for an overview of the simplified method, it will first of all be seen that a blank 24 is created which is an exact duplication of the liner 10 desired to be cast. The blank 24 may be made of any material which is similar to styrofoam in its characteristic of being dissipated by bubbling away at high temperatures.

The blank 24, in a preferred embodiment thereof is made of two sections 26 and 28, a first section 26 of which defines the inner cylindrical wall 12 of the liner 10 and a second section 28 which defines the outer wall 14 of the liner 10, with the sections 26 and 28 of the blank 24 being configured to define a longitudinal cylindrical chamber 30 therebetween, with the chamber 30 being intermittently interrupted by the presence of air throughports 32 girdling the blank 24 and extending from outside of the second section 28 through the first section 26 of the blank 24.

Although the preferred embodiment of the blank 24 is defined as being of two section construction, this is not to be construed as limiting.

Figure 4:
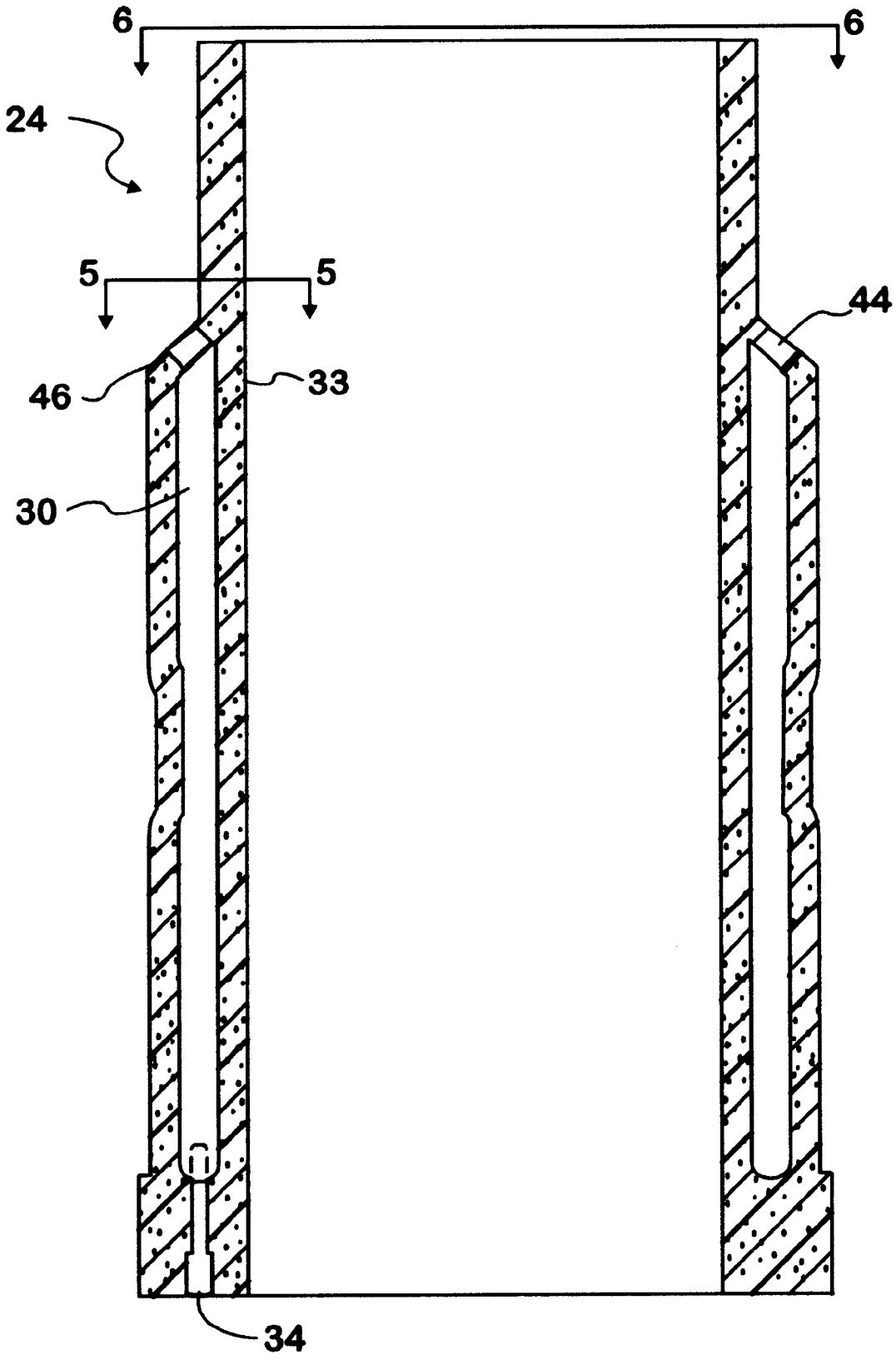
FIG. 4 is a further cross sectional view through the foam blank taken at a diameter perpendicular to that of FIG. 3.

Also, it will be understood that the entrance 18 and exit of the water jacket 16 need not be defined prior to casting, but may be provided by any suitable means such as drilling through an appropriate surface of the cast liner 10 to accommodate any required positioning thereof, as illustrated in FIG. 4, where the second section 28 of the blank 24 is shown to be uninterrupted.

Once the sections 26 and 28 are appropriately joined together, they are then coated almost completely, inside and out, with a coating 33 of a compound known as core wash which will not allow molten metal to seep therepast. Only desired points of ingress and egress are not coated.

For example, if vertical casting were selected, an upper wall 34 of the blank 24, which is downwardly disposed for casting in this instance, would remain intermittently uncoated to produce an ingress for the metal in a bottom-up method.

Figure 3:
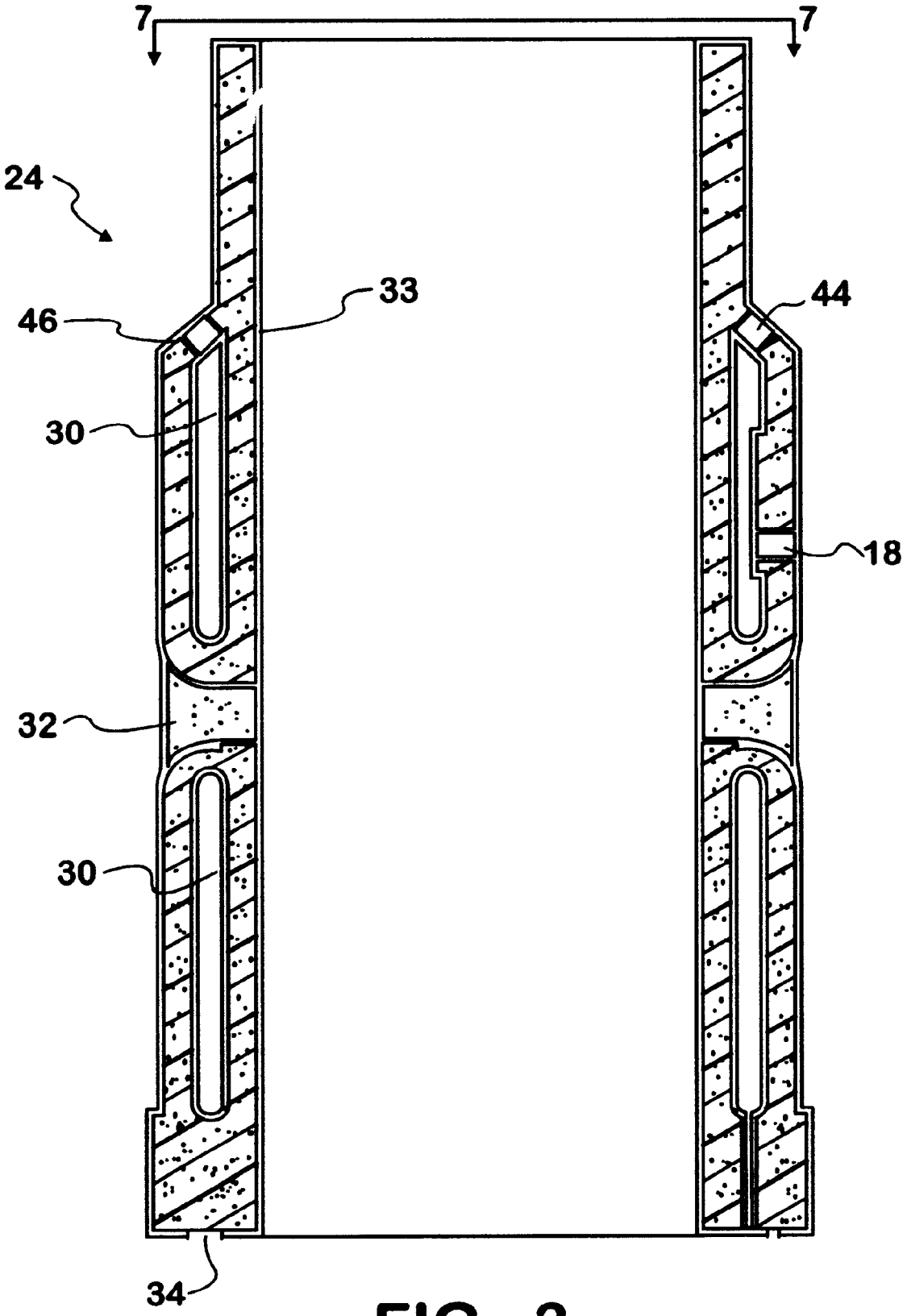
FIG. 3 is an identical cross sectional view through the foam blank of FIG. 2, showing the foam blank only.

One pattern of coating 33 is illustrated in FIG. 3, with the coating 33 being left off the remaining Figures for purposes of clarity.

With the method of the present invention wherein the coating 33 encases the blank 24, a significant benefit is obtained which may not be readily apparent. In this respect, in methods of casting presently utilized, the liner 10 must necessarily undergo a significant amount of machining to have a functionally required configuration because a significant amount of excess metal is inherently present in such casting.

Such required machining is significantly reduced if not altogether eliminated by the present method because the blank 24, in the first instance is identical in configuration to the desired liner 10 to be cast, and, in the second instance, with the coating 33 in place therearound, the metal will not seep past the barrier created by the coating 33, the coating 33 also acting to reduce friction against which the metal is to flow, and therefore allowing the casting to be as near net size as possible. With the liner 10 being created near net size using the present method, it will be understood that any significant machining requirement is avoided.

The coated blank 24 is then inserted into a mold 40 which is of a significantly greater horizontal extent than the blank 24, creating a void 42 around the blank 24.

Further, as illustrated in the drawings, the blank 24 is inserted in a manner where a drain 44 leading into the chamber 30 faces upwardly. In the embodiment illustrated in FIG. 5, for use in vertical casting, the drain 44 is provided in what would be an underside 46 of the section 28 when righted.

It will be understood, however, that the drain 44 may also be provided at a radial point along an upwardly disposed portion of the circumference of the liner 10, if the liner 10 where to be horizontally cast.

Considering the drain 44 in more detail, any suitable configuration thereof for use in filling/draining of the chamber 30 by sand 47 could be used.

Figure 6:
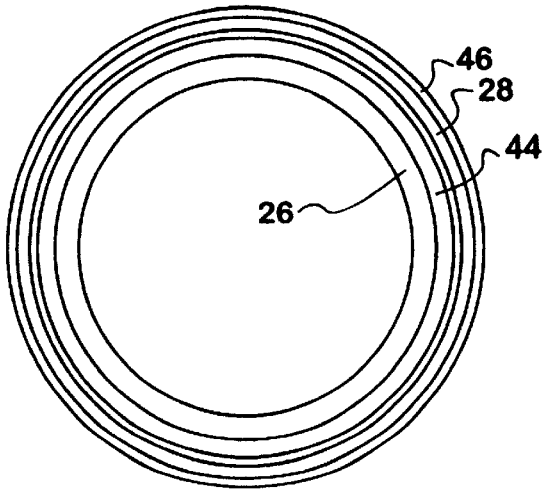
FIG. 6 is a top plan view of the blank showing a first embodiment for the drain port and is taken along line 6—6 of FIG. 4.
Figure 5:
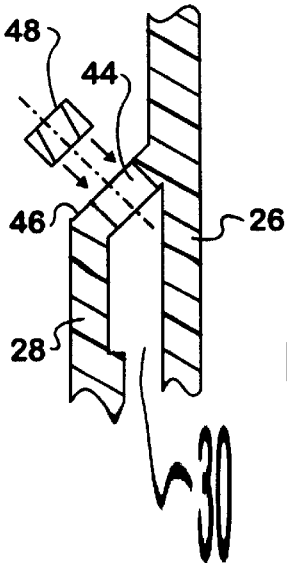
FIG. 5 is an enlarged cross sectional view through a sand drain port of the blank and is taken along line 5—5 of FIG. 4, and shows a cross section of a plug for the port.
Figure 8:
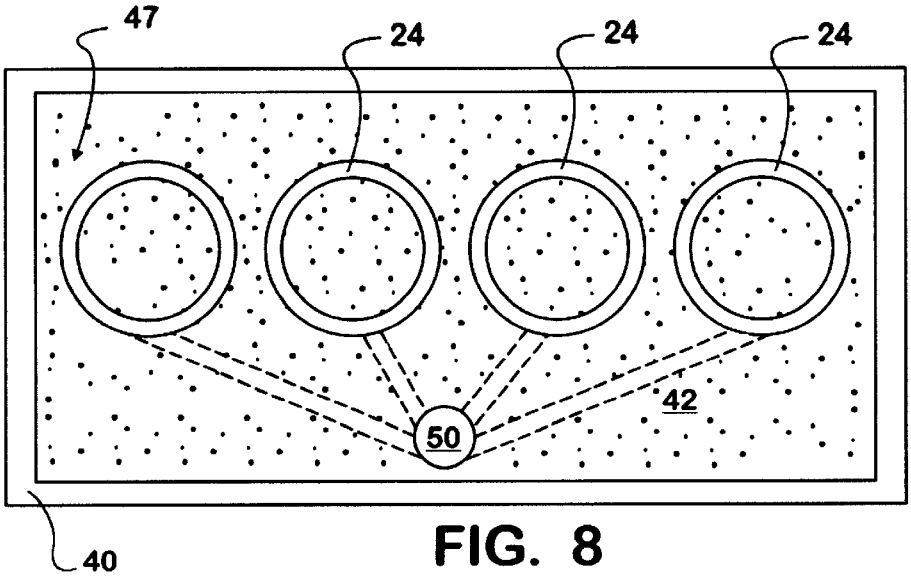
FIG. 8 shows one top plan view of a sand filled mold with a plurality of blanks therein.
Figure 9:
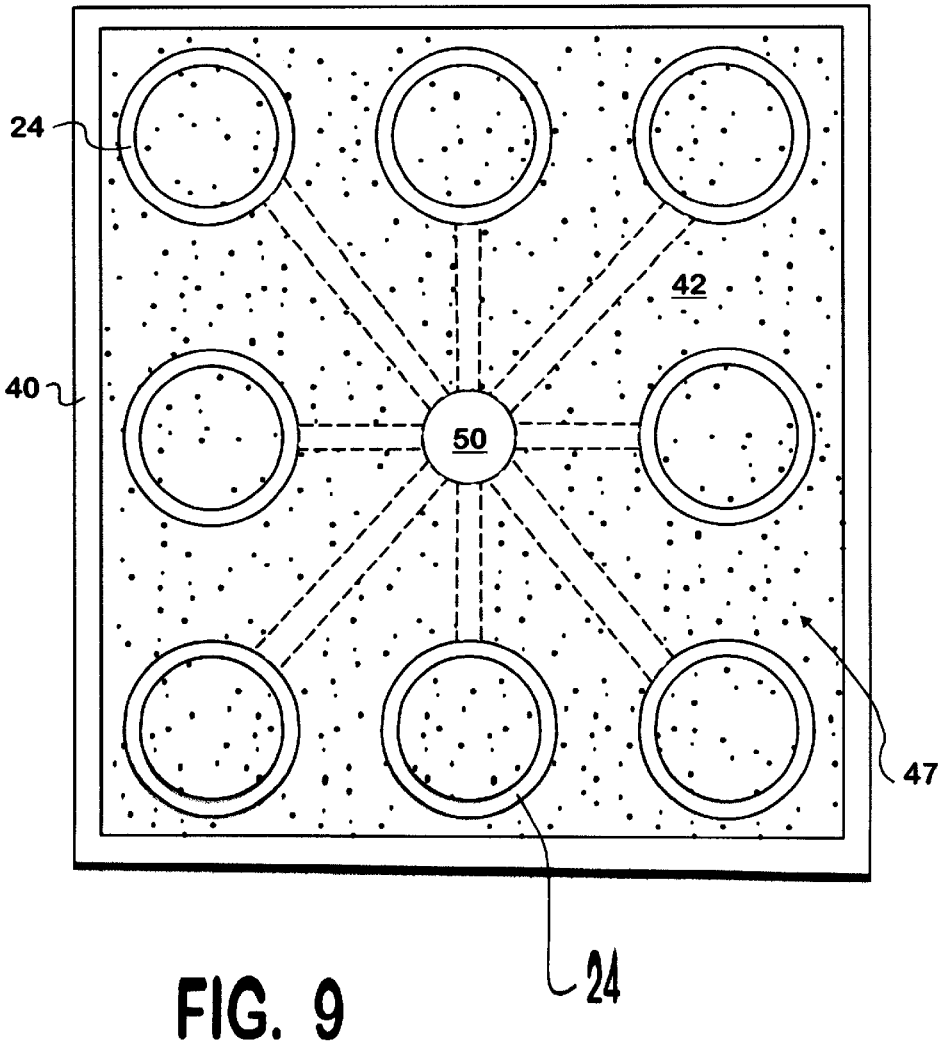
FIG. 9 shows another top plan view of a sand filled mold with a plurality of blanks therein.

In this respect, as illustrated in FIG. 6, the drain 44 could be defined as a circular channel 44 leading into the chamber 30. Such circular channel 44 would be sealed off by engagement of a ring shaped plug 48 therewithin, the plug 48 being fixed to the liner 10 in any suitable manner, such as by welding. A cross section of such plug 48 is shown in FIG. 5.

Figure 7:
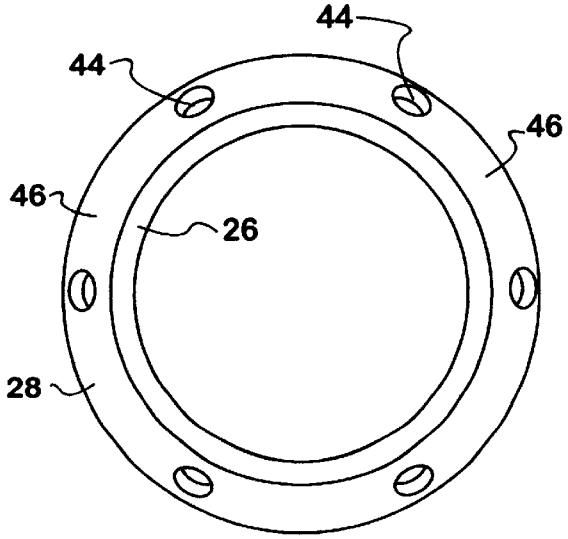
FIG. 7 is a top plan view of the blank showing a second embodiment for the drain port and is taken along line 7—7 of FIG. 3.

Alternatively, the drain 44 could be defined as a radial array of spaced apart bores 44 as illustrated in FIG. 7, with each bore 44 being sealed with a plug 48, a cross section of which is shown in FIG. 5, the plug 48 again being fixed to the liner 10 is any suitable fashion.

It will be understood that sealing of the drain 44, in any workable embodiment thereof, would necessarily take place after the cooled casting of the liner 10 were removed from the mold 40, righted, and drained of sand 47.

Inasmuch as the blank 24 is necessarily identical to the liner 10 to be created therewith, it will logically follow that ports and channels will be provided in and on the blank 24 which are identical to those desired in the cast liner 10.

It must be understood therefore that not only the exterior surfaces of the blank 24 but any surfaces past which molten metal fed into the ingress must not flow must also necessarily be coated with a coating 33 of core wash so as to remain open.

To the contrary end, so that the core wash coating 33 does not interfere with flow of molten metal to necessary areas, it is taught to engage any sections of the blank 24 together prior to dipping in or "coating" with core wash so that the core wash coating 33 does not adhere to the blank 24 at areas defining seams or points of juncture between sections of the blank 24.

Summarizing, the foam blank 24 is created, core washed, and then seated within the mold 40 in a manner placing the drain 44 facing upwardly. Sand 47 is then poured into the mold 40 external and internal to the blank 24, with the chamber 30 between the sections 26 and 28 of the blank 24 also being filled with sand 47 via the drain 44. Molten metal is then delivered into the mold 40 in known manner, causing the styrofoam to dissipate from the bottom up through contact with the rising molten metal, which replaces the styrofoam.

Once the mold 40 is filled with molten metal, the metal is allowed to cool. After cooling, the formed metal liner 10 is removed from within the sand filled mold 40 and turned right side up, as shown in FIG. 1.

Once the liner 10 is righted, gravity takes over, drawing sand 47 out of the chamber 30 through the now downwardly directed drain 44.

Once the sand 47 is removed, the drain 44 is plugged in the manner described above, producing the cylinder liner with water jacket 10, the disclosed method being far simplified over previous methods of manufacture.

The simplicity of the method provides a further distinct advantage. It allows for a plurality of spaced apart blanks 24 to be received within an extended mold 40, with a single sprue 50, used in directing molten metal through the mold 40, being capable of supplying the metal to the plurality of blanks 24, as illustrated, in one embodiment, in FIG. 8, and in a further embodiment in FIG. 9.

Of course, it will be understood that the embodiments illustrated are best suited for vertical casting of the liner 10 and again should not be construed as limiting.

As described above the method of the present invention provides a number of advantages, some of which have been described above and others of which are inherent in the invention. Also, modifications may be proposed to the method without departing from the teachings herein. Accordingly the scope of the invention should only be limited as necessitated by the accompanying claims.

What is claimed is:

1. A method for casting a cylinder liner with water jacket comprising the steps of:

creating a blank of heat-dissipated material substantially identical to the cylinder liner with water jacket to be cast, the blank including a drain therein;

coating substantially all surface of the blank with core wash;

placing the blank inside a mold;

filling the mold, and a chamber defined within the blank with sand;

pouring molten metal into the mold, the molten metal dissipating and replacing the blank, thereby casting the cylinder liner with water jacket;

waiting for the cast metal to cool;

removing the cast metal cylinder liner with water jacket from the mold;

draining sand from the chamber within the cylinder liner with water jacket via the drain; and sealing the drain by suitably fixing a plug therein.

2. The method of claim 1 wherein a plurality of cylinder liners are cast simultaneously.

3. The method of claim 1 wherein the heat dissipated material is styrofoam.

4. The method of claim 3 wherein the styrofoam is in solid form.

5. The method of claim 1 being suited for use in both vertical and horizontal casting techniques.

6. A lost foam method for casting a cylinder liner with water jacket comprising the steps of:

creating a blank of the cylinder liner with water jacket out of styrofoam material with at least one sand drain therein;

coating the blank with core wash;

placing the blank inside a mold;

filling the mold, and a chamber defined within the blank with sand;

pouring molten metal into the mold to replace the styrofoam blank therewith;

waiting for the metal to cool;

removing the created metal cylinder liner with water jacket from the mold;

draining sand from the chamber within the cylinder liner with water jacket via the drain; and sealing the drain by suitably fixing a plug therein.

7. A lost foam method for casting a near net cylinder liner with water jacket requiring significantly reduced if any machining comprising the steps of:

creating a net blank of the cylinder liner with water jacket out of styrofoam material with at least one sand drain therein;

coating the blank with core wash;

placing the blank inside a mold;

filling the mold, and a chamber defined within the blank with sand;

pouring molten metal into the mold to replace the styrofoam blank therewith;

waiting for the metal to cool;

removing the created metal cylinder liner with water jacket from the mold;

draining sand from the chamber within the cylinder liner with water jacket via the drain; and sealing the drain by suitably fixing a plug therein.

* * * * *